United States Patent [19]

von Gnechten et al.

[11] Patent Number: 4,488,675

[45] Date of Patent: Dec. 18, 1984

[54] ONE PIECE INTERLOCKING OUTFOLD CONTAINER

[75] Inventors: Lawrence A. von Gnechten, Mosinee; Thomas E. Byrnes, Adams; John C. Lasky, Wisconsin Rapids, all of Wis.

[73] Assignee: Consolidated Papers, Inc., Wisconsin Rapids, Wis.

[21] Appl. No.: 481,294

[22] Filed: Apr. 1, 1983

[51] Int. Cl.[3] ..... B65D 5/22; B65D 5/66

[52] U.S. Cl. ..... 229/33; 229/36; 229/44 R

[58] Field of Search ..... 229/33, 36, 44 R, 23 BT, 229/23 R

[56] References Cited

U.S. PATENT DOCUMENTS

| | | | |
|---|---|---|---|
| 1,667,975 | 5/1928 | Labombarde | 229/33 |
| 2,119,058 | 5/1938 | Richardson | 229/33 X |
| 2,255,223 | 9/1941 | Lighter | 229/36 X |
| 2,354,083 | 7/1944 | Bixby | 229/33 X |
| 2,581,105 | 1/1952 | Hunsworth | 229/23 R |
| 2,643,047 | 6/1953 | O'Reilly | 229/44 R |
| 3,276,662 | 10/1966 | Farquhar | 229/23 BT X |
| 3,365,112 | 1/1968 | Priest et al. | 229/23 R |
| 4,133,430 | 1/1979 | Cravens | 229/23 BT X |
| 4,211,322 | 7/1980 | Crescenzi et al. | 229/33 X |

*Primary Examiner*—William Price
*Assistant Examiner*—Gary E. Elkins
*Attorney, Agent, or Firm*—Gary, Juettner & Pyle

[57] ABSTRACT

A die cut one piece interlocking outfold container has interlocking of inside and outside flaps. A cover length flap of the container folds outside of a body length flap, and cover width flaps fold inside of body width flaps. The particular configuration results in the container having plural thickness front, back and side walls, which increases the stacking strength of the container.

6 Claims, 6 Drawing Figures

ONE PIECE INTERLOCKING OUTFOLD CONTAINER

BACKGROUND OF THE INVENTION

The present invention relates to corrugated containers in general, and in particular to an improved one piece interlocking outfold container which has plural thickness front, back and side walls for increased stacking strength.

Cardboard or corrugated boxes or containers are used to package various goods. Conventionally, such a container comprises a rectangular cardboard sleeve which is slit along its corners at each of its ends to define four flaps at each end. To form the container bottom wall, a pair of opposed flaps at one end of the sleeve is folded inwardly of the sleeve, the other pair of flaps is folded inwardly of the sleeve and across the one pair, and the flaps are secured in folded position by adhesive, tape or any other suitable means. Goods may then be placed in the container through the opposite open end, whereafter the end is closed by folding and sealing the flaps thereat to provide a closed cover on the container.

A difficulty encountered with conventional containers is that the front, back and side walls thereof comprise only a single thickness of cardboard, i.e., the walls of the container are the sides of the sleeve. In consequence, the containers have limited stacking strength, and when heavily loaded and stacked one on top of the other they tend to collapse. To give the containers greater stacking strength, it is known to insert a separate corrugated cardboard liner or sleeve around the goods therein. The sleeve has the same height as the container, and gives the container greater vertical ridigity. However, it is expensive and inconvenient to store a supply of and use separate tubular liners.

Another disadvantage of such containers is that to facilitate shipping and storage, the rectangular cardboard sleeves are folded flat during shipment and storage and until such time as the container is to be formed and used. Consequently, the user must provide his own means for securing the flaps closed at opposite ends of the sleeve to form the container bottom and cover.

OBJECT OF THE INVENTION

The primary object of the present invention is to provide a one piece interlocking outfold corrugated container which may be folded flat for shipment and storage, has plural thickness side walls when formed and closed for increased stacking strength and does not require separate means for closing and securing top and bottom walls thereof.

SUMMARY OF THE INVENTION

In accordance with the present invention, there is provided an outfold container which comprises a one piece cutout of a sheet of corrugated material forming a rectangular box and a cover for said box. Said rectangular box has a bottom wall, a front wall, a back wall, a pair of side walls and an open upper end, and said back wall includes at least two thickness of said corrugated material. Said cover has a rectangular top wall hingedly connected along a back edge thereof with an upper edge of said box back wall, a pair of side walls connected to opposite side edges of said top wall and extending perpendicular therefrom and a front wall connected to a front edge of said top wall and to side edges of said cover side walls and extending perpendicular therefrom. Said cover is pivotable between a container open position away from said open upper end of said box and a container closed position whereat said cover side walls extend across and to the interior of respective ones of said box side walls, said cover front wall extends across and to the exterior of said box front wall and said cover top wall extends across and closes said open upper end of said box. Said cover and box front and side walls have substantially the same height, whereby when said cover is closed front, back and side walls of said container are each of at least two thicknesses of corrugated material and said container has increased stacking strength.

The foregoing and other objects, advantages and features of the invention will become apparent upon a consideration of the following detailed description, when taken in conjunction with the accompanying drawings.

DETAILED DESCRIPTION

Figure 1:
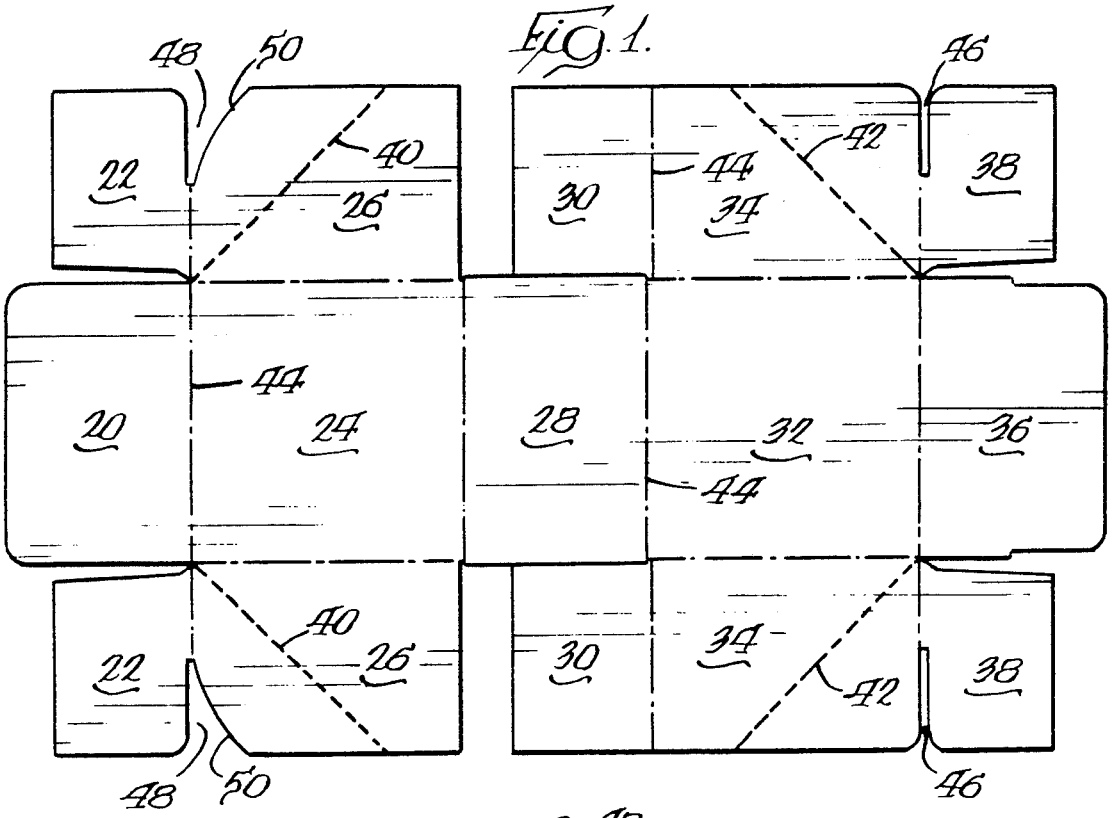
FIG. 1 is a plan view of a flat cardboard cutout for forming the container, showing the configuration of the cutout prior to being folded and formed.

Referring to the drawings, FIG. 1 shows the outline of a cardboard or corrugated cutout which is advantageously die cut from a main supply sheet of corrugated material and configured for being formed into a one piece interlocking outfold container which has multiple thickness front, back and side walls for increased stacking strength. As initially due cut, the cutout is flat and includes a cover length flap 20, a pair of cover length strengthening flaps 22, a cover 24 and a pair of cover width flaps 26. The cutout also has a back wall 28 and a pair of back wall strengthening flaps 30, along with a bottom 32, a pair of body width flaps 34, a body length flap 36 and a pair of body length strengthening flaps 38. Perforation lines 40, which may be $\frac{1}{4}''/\frac{1}{4}''$, extend along the cover width flaps 26, and perforation lines 42 extend along the body width flaps 34. To facilitate folding and forming the cutout into a container, as shown by phantom lines crease lines 44 are provided between the various walls and flaps.

Figure 2:
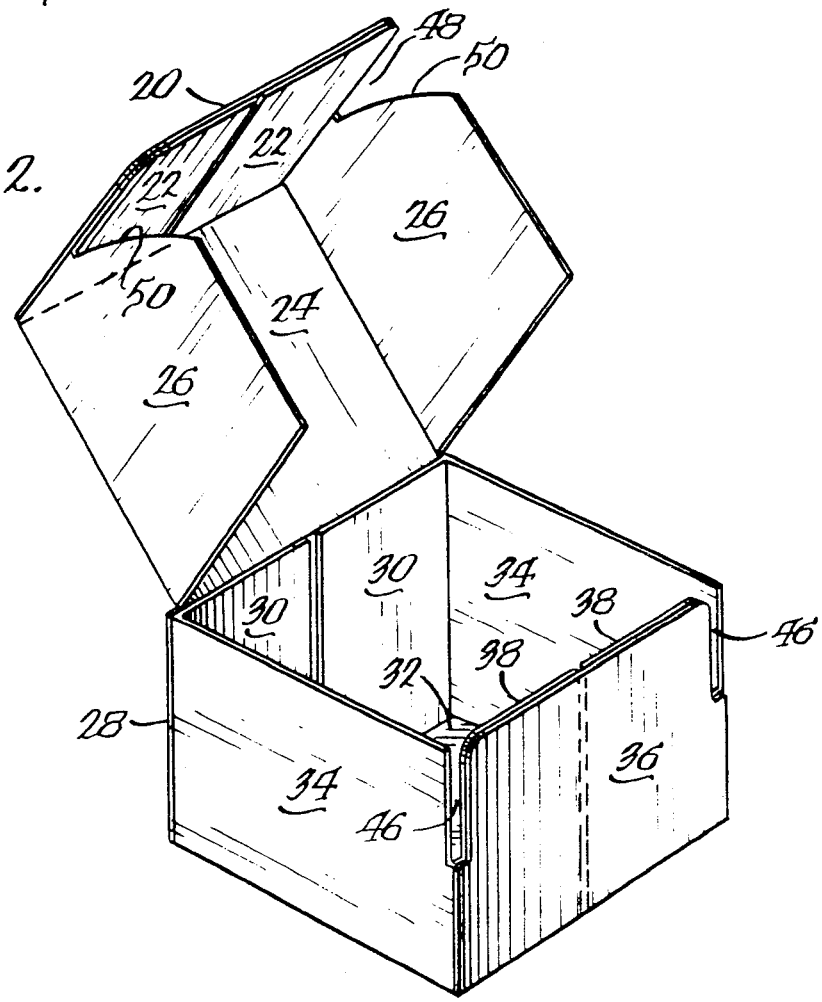
FIG. 2 is a perspective view of the formed container, illustrating the same in condition for being loaded.
Figure 3:
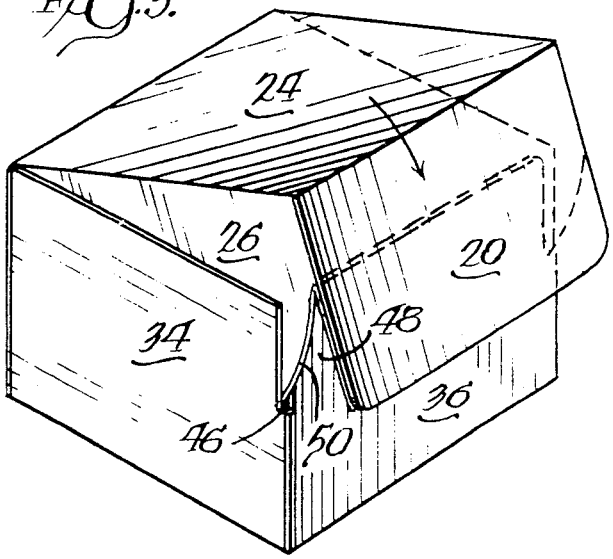
FIG. 3 is a perspective view of the container, and shows the relationship of the cover length flap, the cover width flaps, the body width flaps and the body length flap as the container is being closed.

After die cutting and prior to shipping the cutout to a user, the cutout is partially manufactured. To that end, and with reference also to FIG. 2, the cover length strengthening flaps 22 are folded 90° with respect to the cover width flaps 26, and the cover width flaps and the cover length flap 20 are then folded 90° with respect to the cover 24. This positions the cover length strengthening flaps 22 across opposite sides of the cover length flap 20 for being secured thereto by any suitable means, such as by adhesive. Also, the body length strengthening flaps 38 re folded 90° with respect to the body width flaps 34, and the body width flaps and the body length flap 36 are then folded 90° with respect to the bottom 32. This positions the body length strengthening flaps 38 across opposite sides of the body length flap 36 for being secured thereto. As is apparent, after the cover length strengthening flaps 22 are bonded to the cover length flap 20 and the body length strengthening flaps 38 are bonded to the body length flap 36, opposite ends of the cutout will extend at 90° with respect to the remainder thereof, which would not be satisfactory for shipping or storage purposes. Therefore, so that the partially fabricated cutout may be folded flat, the perforation lines 40 and 42 enable the cover length flap 20 and the cover length strengthening flaps 22 to be folded over the cover 24 and the cover width flaps 26, and the body length flap 36 and the body length strengthening flaps 38 to be folded flat over the bottom 32 and the body width flaps 34. As folded, the paritally manufactured cutout is substantially flat for convenient shipping in quantity to and storage by a user.

To finish forming the partially manufactured cutout into a container, a user simply unfolds the cover length flap 20 and its cover length strengthening flaps 22 to place the same, along with the cover width flaps 26, at 90° with respect to the cover 24, and unfolds the body length flap 36 and its body length strengthening flaps 38 to place same, along with the body width flaps 34, at 90° with respect to the bottom 32. The back wall strengthening flaps 30 are then folded inwardly of the bottom 32 and to a position at 90° with respect to the body witdth flaps 34, and the back wall 28 is folded to be at 90° with respect to the bottom. At this point, the back wall strengthening flaps 30 extend across the back wall 28 and the container is formed to essentially the configuration shown in FIG. 2 for having goods to be packaged therein.

Figure 4:
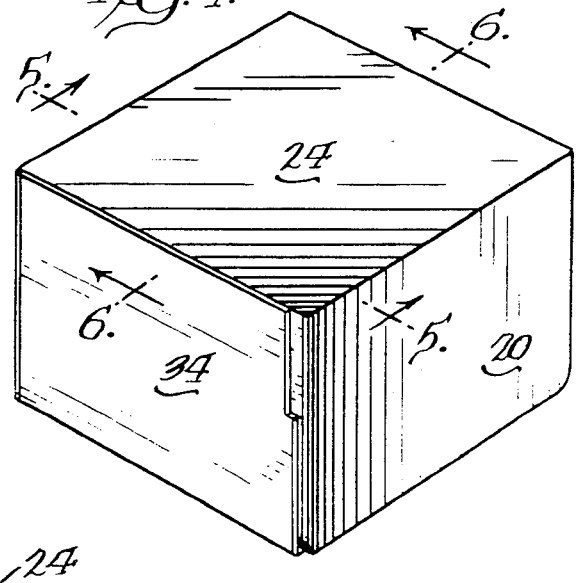
FIG. 4 is a perspective view of the container in fully closed condition.

After goods are packaged in the container, the container is closed by folding the cover width flaps 26 inside of the body width flaps 34 and the cover 20, together with its strengthening flaps 22, across the outside of the body length flap 36. For the purpose, slits 46 are formed between the body width flaps 34 and the body length strengthening flaps 38, openings 48 are formed between the cover width flaps 26 and the cover length strengthening flaps 22, and the cover width flaps are cut back to have arcuate edges 50 within the openings 48. Thus, as the container is closed the slits 46 permit movement therethrough of the edges of the cover width flaps 26, including the arcuate edges 50, and together with the openings 48 enable the container to be fully and completely closed to position the cover 24 generally parallel to the bottom 32. FIG. 4 shows the container fully closed, at which point the slits 46 accommodate the connected portions of the cover length strengthening flaps 22 and the cover width flaps 26, and the openings 48 accommodate the connected portions of the body length strengthening flaps 38 and the body width flaps 34. If desired, the container may be fastened in closed position by tape, adhesive, staples or the like, or by being extended into a open ended rectangular sleeve.

Figure 5:
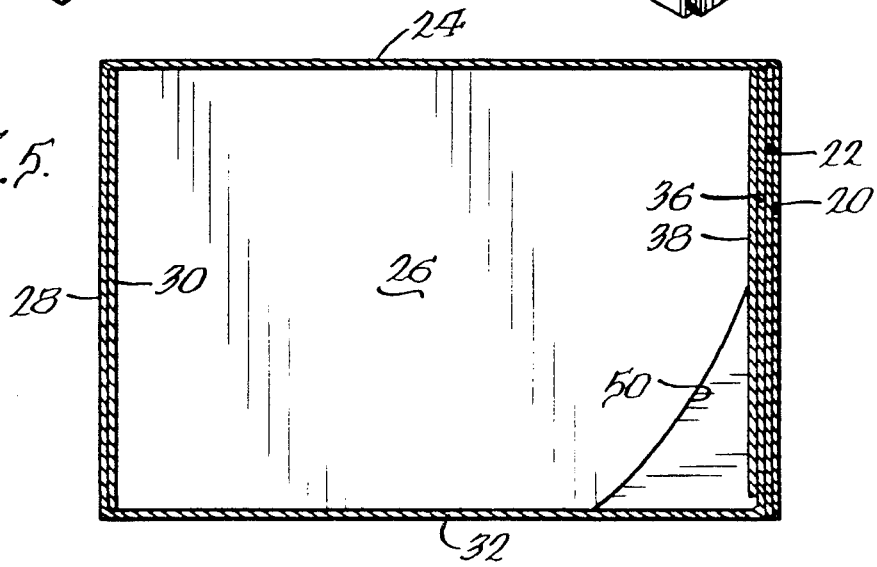
FIGS. 5 and 6 are cross sectional views respectively taken along the lines 5—5 and 6—6 of FIG. 4, and show the plural thickness side walls of the container when the container is closed.
Figure 6:
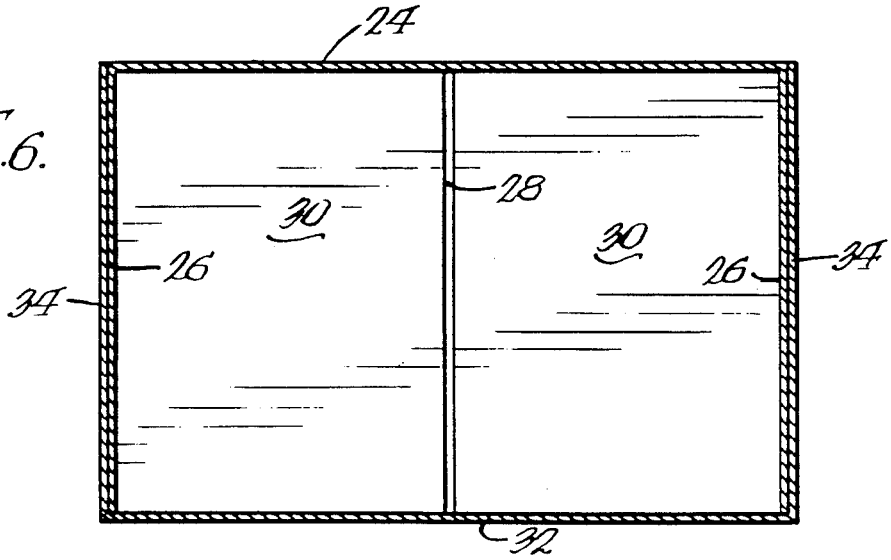

FIGS. 5 and 6 illustrate the multiple ply or plural thickness side walls of the closed container which give it significantly improved vertical stacking strength without need for separate inserts or liners within the container. As seen in FIG. 5, a rear side of the container is of double thickness, and comprises the back wall 28 and its back wall strengthening flaps 30. A front side of the container, comprising the cover length flap 20, the cover length strengthening flaps 22, the body length flap 36 and the body length strengthening flaps 38 is of quadruple thickness, while as shown in FIG. 6 each of the side walls, which comprise the cover width flaps 26 and the body width flaps 34, are of double thickness. Consequently, as compared with a conventional regular slotted container, the side walls of which are only of single thickness and not capable of imparting to the container significant vertical stacking strength, all of the front, back and side walls of the container of the invention are of at least double thickness.

The invention therefore provides an improved corrugated container. Because all of the container front, back and side walls are at least double ply or of at least double thickness, the container has significantly improved vertical rigidity or stacking strength, and does not readily collapse even when subjected to significant vertical pressures. In addition, by virture of the partial manufacturing of the container during its manufacture, and of its unitary structure and the manner in which it is closed, a user need not be concerned with providing separate means for fastening the container in formed condition and maintaining the container closed.

While one embodiment of the invention has been described in detail, various modifications and other embodiments thereof may be devised by one skilled in the art without departing from the spirit and scope of the invention, as defined in the appended claims.

What is claimed is:

1. An outfold container, comprising a one piece cutout of a sheet of corrugated material forming a rectangular box and a cover for said body, said rectangular box having a bottom wall, a front wall, a back wall, a pair of side walls and an open upper end, said back wall including at least two thicknesses of said corrugated material, said cover having a rectangular top wall hingedly connected along a back edge thereof with an upper edge of said box back wall, a pair of side walls connected to opposite side edges of said top wall and extending perpendicular therefrom and a front wall connected to a front edge of said top wall and to side edges of said cover side walls and extending perpendicular therefrom, said cover being pivotable between a container open position away from said open upper end of said box and a container closed position whereat said cover side walls extend across and to the interior of respective ones of said box side walls, said cover front wall extends across and to the exterior of said box front wall and said cover top wall extends across and closes said open upper end of said box, said cover and box front and side walls having substantially the same height, whereby when said cover is closed, front, back and side walls of said container are each of at least two thicknesses of corrugated material and said container has increased stacking strength, wherein said box back wall has an outer back wall and two strengthening flaps each extending from a respective side wall substantially halfway across an interior surface of said outer back wall, said box front wall has an outer front wall and a pair of strengthening flaps each extending from a respective box side wall substantially halfway across an interior surface of said box outer front wall, and said cover front wall has an outer fron wall and a pair of strengthening flaps each extending from a respective cover side wall substantially halfway across an interior surface of said cover outer front wall, whereby when said cover is closed said container has back and side walls of double thickness and a front wall of quadruple thickness, and wherein each corner between said rectangular box front and side walls is slotted between an upper end and a point spaced from a lower end thereof, and each corner between said cover front and side walls is opened between a lower end and a point spaced from an upper end thereof, said slots accommodating the connected portions of said cover front and side walls and said openings accommodating the connected portions of said box front and side walls when said cover is moved to said container closed position.

2. An outfold container as in claim, 1 wherein said cover side walls have cutout areas defining said openings and arcuate edges extending from closed ends of said openings away from said cover front wall, said arcuate edges facilitating movement of said cover side walls through and past closed ends of said slots when said cover is moved to said container closed position.

3. An outfold container, comprising a one piece cutout of a sheet of corrugated material having a plurality of generally rectangular and planar elements including a cover length flap; a cover panel hingedly connected along a front edge thereof to a top edge of said cover length flap; a pair of cover width flaps each hingedly connected along a top edge thereof to a respective side edge of said cover panel; a pair of cover length strengthening flaps each hingedly connected along a side edge thereof to a side edge of a respective one of said cover width flaps adjacent said cover length flap; a back wall hingedly connected along an upper edge thereof to a back edge of said cover panel; a bottom wall hingedly connected along a back edge thereof to a bottom edge of said back wall; a pair of body width flaps each hingedly connected along a bottom edge thereof to a respective side edge of said bottom wall; a pair of back wall strengthening flaps each hingedly connected along a side edge thereof to a side edge of a respective one of said body width flaps adjacent said back wall; a body length flap hingedly connected along a bottom edge thereof to a front edge of said bottom wall; and a pair of body length strengthening flaps each hingedly connected along a side edge thereof to a side edge of a respective one of said body width flaps adjacent said body length flap, wherein each said cover length strengthening flap is foldable to extend at 90° with respect to its associated cover width flap and said cover length flap and said cover width flaps are foldable to extend at 90° with respect to said cover panel to position said cover length strengthening flaps substantially across opposite halves of an interior surface of said cover length flap to form a cover for said container, each said body length strengthening flap is foldable to extend at 90° with respect to its associated body width flap, said body length flap and body width flaps are foldable to extend at 90° with respect to said bottom wall to position said body length strengthening flaps substantially across opposite halves of an interior surface of said body length flap, each said back wall strengthening flap is foldable to extend at 90° with respect to its associated body width flap and said back wall is foldable to extend at 90° with respect to said bottom wall so that said back wall strengthening flaps are positioned substantially across opposite halves of an interior surface of said back wall, thereby to form a box portion of said container which has an open upper end, said cover being pivotable about said back wall toward said open upper end of said box portion to extend each said cover width flap across and to the interior of an associated one of said body width flaps, to extend said cover length flap and said cover length strengthening flaps across and to the exterior of said body length flap and to move said cover panel across said open upper end of said box portion in generally parallel relation to said bottom wall, whereby said closed container has plural thickness front, back and side walls for increased stacking strength, wherein said container, when closed, has double thickness back and side walls and a quadruple thickness front wall, said body width flaps and their respective body length strengthening flaps are spaced apart along a portion of their hingedly connected side edges to define open ended slots therebetween toward upper ends thereof, and said cover width flaps and their associated cover length strengthening flaps are spaced apart along a portion of their hingedly connected side edges to define openings therebetween toward lower ends thereof, said slots accommodating movement of said cover width flaps to interior of said body width flaps when said cover is moved to the position closing said container, said slots then receiving the hingedly connected portions of said cover width flaps and said cover length strengthening flaps and said openings receiving the hingedly connected portions of said body width flaps and said body length strengthening flaps.

4. An outfold container as in claim 3, including means for securing each said cover length strengthening flap to and across its associated half of said cover length flap and each said body length strengthening flap to and across its associated half of said body length flap.

5. An outfold container as in claim 3, wherein said elements are hingedly connected by means of fold lines in said one piece cutout of corrugated material.

6. An outfold container as in claim 3, wherein said edges of said cover width flaps in said openings are arcuately curved away from said cover length strengthening flaps to facilitate movement of said cover width flaps through said slots to the interior of said body width flaps.

* * * * *